United States Patent [19]

North et al.

[11] 4,313,394

[45] Feb. 2, 1982

[54] PRINTING APPARATUS

[75] Inventors: Steven F. North, Norcross; Robert B. Sprow, Dunwoody, both of Ga.

[73] Assignee: Western Electric Company, Inc., New York, N.Y.

[21] Appl. No.: 132,042

[22] Filed: Mar. 20, 1980

[51] Int. Cl.[3] ..... B05C 5/00

[52] U.S. Cl. ..... 118/323; 118/314; 118/325; 118/DIG. 21; 101/35; 400/126; 239/223

[58] Field of Search ..... 101/35, 36, 37, 4, 5, 101/6; 400/126; 239/222, 223, 224; 118/314, 313, 316, 323, 325, DIG. 21

[56] References Cited

U.S. PATENT DOCUMENTS

| | | | |
|---|---|---|---|
| Re. 24,602 | 2/1959 | Simmons . | |
| 1,022,956 | 4/1912 | Lengerke et al. | 239/121 |
| 2,168,917 | 8/1939 | Perkins . | |
| 2,865,323 | 12/1958 | Hoff | 118/314 |
| 2,989,943 | 6/1961 | Fitzgerald et al. | 118/314 |
| 3,021,815 | 2/1962 | Burke et al. | 118/314 |
| 3,103,311 | 9/1963 | Kempf | 239/224 X |
| 3,250,473 | 5/1966 | Hege | 239/224 X |
| 3,387,992 | 6/1968 | Arthur et al. | 118/314 X |
| 3,455,728 | 7/1969 | Kiwiet | 118/314 X |
| 4,077,322 | 3/1978 | Fardeau | 400/126 X |

FOREIGN PATENT DOCUMENTS

| | | | |
|---|---|---|---|
| 2308543 | 8/1974 | Fed. Rep. of Germany | 118/325 |
| 2319426 | 2/1977 | France | 118/323 |

*Primary Examiner*—Edgar S. Burr
*Assistant Examiner*—Charles A. Pearson
*Attorney, Agent, or Firm*—Robert Bruce Kennedy

[57] ABSTRACT

Apparatus is disclosed for printing encoded markings on elongated material comprising a first disc (41) having raised lands (46) extending between central and peripheral disc regions, and a second disc (42) mounted to the first disc flush against the raised lands. A third disc (40) having raised lands is mounted to the second disc with its raised lands flush against the second disc. Means (61, 62) are provided for altering the radial position of the first and second discs relative to each other.

6 Claims, 14 Drawing Figures

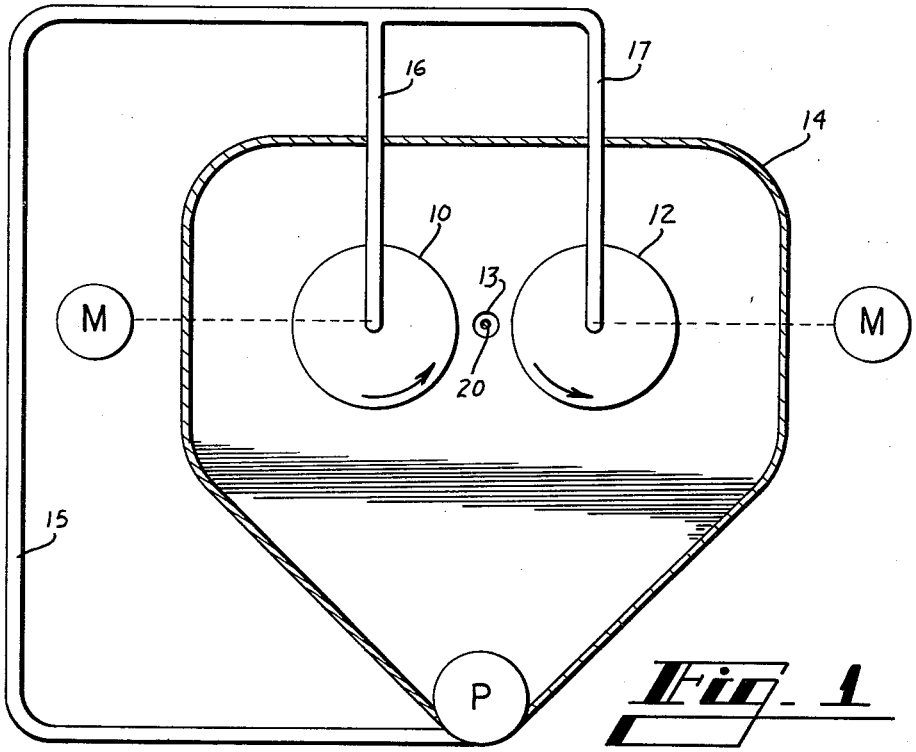
Fig. 1
PRIOR ART
Fig. 2
PRIOR ART
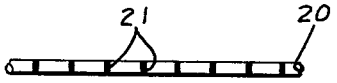
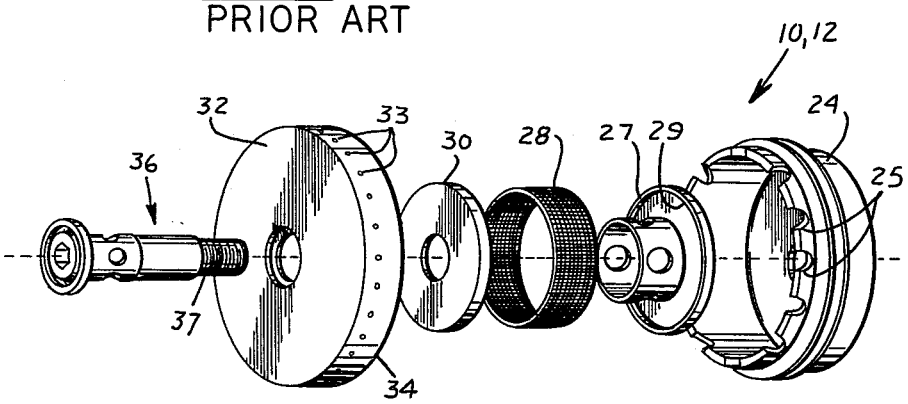
Fig. 3
PRIOR ART

PRINTING APPARATUS

TECHNICAL FIELD

This invention relates to apparatuses for printing encoded markings on elongated material.

BACKGROUND OF THE INVENTION

It is often desirable to print markings on elongated material, such as insulated wires to be stranded into a cable, for identification purposes. This has heretofore been done with apparatuses of a type such as that illustrated in U.S. Pat. No. 2,865,323, which is assigned to the assignee of the present invention. This type of apparatus includes a rotatable disc-shaped device which has a set of peripheral orifices from which individual streams of a liquid printing medium such as ink may be radially emitted. By passing an insulated wire beside the rotating device along a route paralleling that of the axis of device rotation, individually spaced marks may be printed on the side of the wire facing the rotating device. By passing the wire between two of such devices, a series of annular bands may be printed.

FIGS. 1–3 of the drawing illustrate in further detail an example of apparatus of the prior art for printing encoded markings on elongated material. Here a pair of disc-shaped devices 10 and 12 are seen to be rotatably driven by motors M about mutually parallel axes within an enclosure 14. The apparatus includes a system for recirculating a liquid marking medium such as ink comprised of a pump P located within a sump portion of the enclosure, and a series of conduits 15, 16 and 17 through which the marking medium may be pumped from the sump into the two disc-shaped devices. By passing a wire 20 between the two rotating devices along an axis paralleling those of the two rotating devices through enclosure ports 13, a series of annular bands 21 may be printed on the wire as shown in FIG. 2.

In FIG. 3 each of the disc-shaped devices is seen to include a centrally apertured, cup shaped member 24 having an annularly arranged series of grooves 25, a flanged collar 27, a band screen 28 sized to be seated within a rim 29 of the flanged collar 27, a ring 30, and another centrally apertured cup shaped member 32 having a series of orifices 33 formed in its annular rim 34. The device also includes a hollow bolt 36 having a threaded end 37 which extends through each of the just described elements and threadedly into a drive shaft in fastening the members together into a motor driven assembly. So assembled, rotary drive may be applied to bolt 36 and liquid ink pumped into the assembly through the hollow bolts 36 and then radially outward from the rotating assembly through the orifices 33. The orifices of each of the two disc-shaped devices 10 and 12 are aligned so as to direct streams of liquid ink onto the wire 20 driven therebetween through the enclosure to form the annular bands 21 shown in FIG. 2.

Unfortunately, notwithstanding the inclusion of a screening or filtering element, printing apparatuses of the type just described have tended to become readily clogged. This may be attributable to the fact that the orifices 33 have had to be of relatively small size in order to provide well defined yet continuous ink streams to be sprayed onto elongated material being moved rapidly thereby for only brief periods of time and thereby print bands of relatively narrow widths. This predicated smallness of orifice size has enabled pigments to accumulate in the orifices and create clogging. Furthermore, it sometimes occurs that solid or semi-solid lumps or globules are to be found in the marking medium which also tend to clog the devices. Where either paints or inks are used globules may be formed by drying as from exposure to air.

Another problem with these prior art type printing apparatuses has been that associated with making changes in code markings. In order to distinguish specific wires within a bundle of wires it is often necessary to place differently encoded or identifying marks on each of the wires. Typically, this is either done by the use of marking medium of different colors, the use of different spacings between the marks, the use of different mark widths, or a combination of these. Where one specific device is to be used to print marks of different sizes or spacings it has been necessary to change that member having the peripheral orifices in order to change the orifice sizes to make wider or narrow bands or to change the angular spacing between the orifices in order to alter the spacing between the marks. This is attributable to the fact that it is rarely feasible to effect such changes in the marks by varying the speed of either the wire or the printing apparatus. In order to change the size orifice or the arrangement of the orifices, it is necessary to disassemble the rotary device and substitute one of its components with another. This is a time consuming and messy task.

Accordingly, it is to these problems to which the present invention is primarily directed.

SUMMARY OF THE INVENTION

In one form of the invention apparatus is provided for printing encoded markings on elongated material which comprises a first disc having a plurality of raised lands extending between central and peripheral disc regions, and a second disc mounted to the first disc flush against the raised lands. Means are provided for rotating the first and second discs together about an axis extending through the first disc central region. Means are also provided for channeling a liquid marking medium to the first disc central region. So constructed, upon rotation of the discs liquid marking medium channeled to the first disc central region is propelled outwardly therefrom by centrifugal force along rotatably leading side walls of the first disc raised lands and onto elongated material moved by the apparatus.

In another preferred form of the invention apparatus is provided for printing encoded markings on elongated material which comprises a plurality of discs mountable together along a common axis to form an assembly that defines two axially spaced sets of channels that radiate outwardly from adjacent said common axis. Means are provided for mounting the discs together into said assembly about the common axis. Means are also provided for rotating the assembly about the common axis and for channeling a liquid marking medium into the channels. Means are further provided for altering the radial position of one of the sets of channels relative to the other and thereby alter the spacings between marks printed on elongated material moved passed the assembly.

In yet another preferred form of the invention apparatus is provided for printing encoded markings on elongated material which comprises a general disc-shaped member defining a plurality of radially spaced channels extending inwardly from the periphery of the member with each channel having, upon rotation of the disc-shaped member in a preselected rotary direction, a rotary trailing cross-sectional side portion of generally wedge-shaped cross-section from which a rotary leading side portion extends. Means are provided for rotating the disc-shaped member in the predetermined direction and for channeling a liquid marking medium to each of the channels at a rate less than that sufficient to completely fill the channels. So constructed, upon rotation of the disc-shaped member in the preselected rotary direction independent streams of the marking medium may be caused to flow along the trailing side portion of the channels to the member periphery and carry any solid or semi-solid globules of a size larger than the stream in cross-section which globules may in transit extend out of the stream and into the channel rotary leading side portion.

BRIEF DESCRIPTION OF THE DRAWING

FIG. 1 is a diagramatical view of apparatus for printing encoded markings on elongated material in accordance with the prior art as previously described.

FIG. 2 is a side elevational view of a segment of elongated material having encoded markings printed thereon by the apparatus illustrated in FIG. 1.

FIG. 3 is an exploded view, in perspective, of a rotatable component of the apparatus illustrated in FIG. 1 in accordance with the prior art.

DETAILED DESCRIPTION

Figure 4:
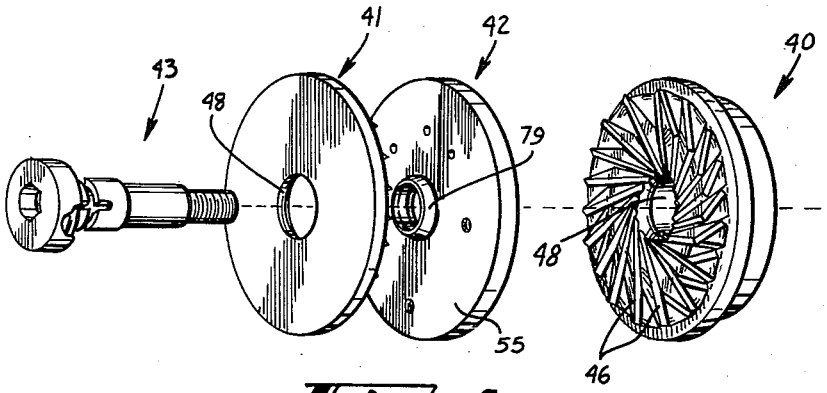
FIG. 4 is an exploded view, in perspective, of apparatus embodying principles of the present invention in a preferred form.
Figure 5:
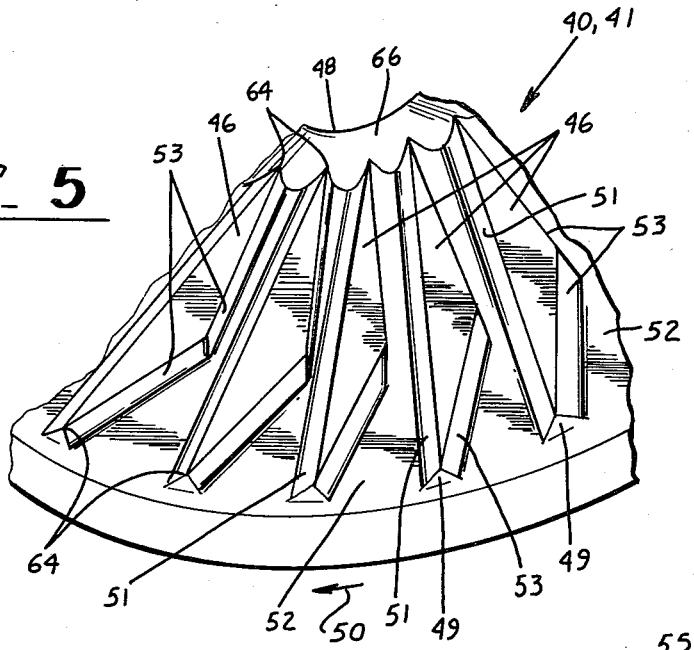
FIG. 5 is a enlarged view, in perspective, of a fragment of one of the elements of the apparatus depicted in FIG. 4.

Referring again to the drawing, there is shown in FIGS. 4–5, 7–9 and 13 apparatus for printing coded, identifying markings on elongated material such as insulated wires which may be advantageously substituted for the disc-shaped devices 10 and 12 of the prior art apparatus illustrated in FIGS. 1–3. Here, the apparatus comprises two generally disc-shaped end members 40 and 41 sandwiched about an intermediate disc-shaped member 42 and held snuggly together by a hollow bolt 43 to form an assembly 44. The two outer members 40 and 41 have confronting, mirror image faces formed with raised lands 46 which extend outwardly from central apertures to triangular tips 49 at the peripheral region of the members. The central aperture of each is bounded by a cylindrical wall section 48 that extends between two conically flared wall sections 66.

When rotated in the direction of arrow 50 each land presents a rotary leading side wall 51 which is canted and slopes upwardly from a planar surface or floor 52, and a rotary trailing side wall 53 which also is canted and slopes upwardly from the floor 52 inclined towards and thus convergent upon the rotary leading wall. Each land is seen to be of triangular shape and together define channels between their side walls above floor 52 that enlarge towards the peripheral region of the disc-shaped member. Being of overall triangular shape, the convergent side walls of the lands come together into contact at points 64 adjacent the central and outer regions of the disc shaped members to give the land tips 49 also a triangular shape. The tops of the land are flat and mutually coplanar so that they may be secured flushly against the planar surfaces 55 of the intermediate disc-shaped member 42 to close the tops of the channels.

Figure 8:
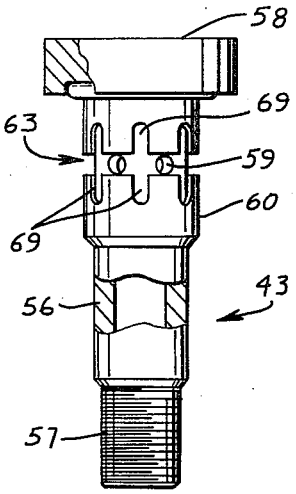
FIG. 8 is a side-elevational view, partly in cross-section, of a bolt component of the apparatus shown in FIG. 4.

The bolt 43 is seen to have a hollow shank 56 which extends between tubular threaded end 57 and a solid bolt head 58. Four apertures 59 are formed in an enlarged shank portion 60 adjacent head 58 to provide fluid communication between interior and exterior portions of the shank as best seen in FIG. 8. A series of axially oriented tributary channels 69 communicate with the annular channel 63. When assembled to the three disc-shaped members the annular channel 63 is capped by the walls of the central aperture of member 42 while the ends of the tributary extend to tapered wall extensions 79 that project from the otherwise planar faces of the disc-shaped member 42. This configuration serves to cause liquid marking medium introduced into the assembly through the hollow bolt to be distributed approximately equally to the two sets of channels provided by the two end members 40 and 41 in conjunction with the intermediate member 42. Otherwise, the channels of member 40 would tend to receive a disproportionately larger share of the medium.

Figure 6:
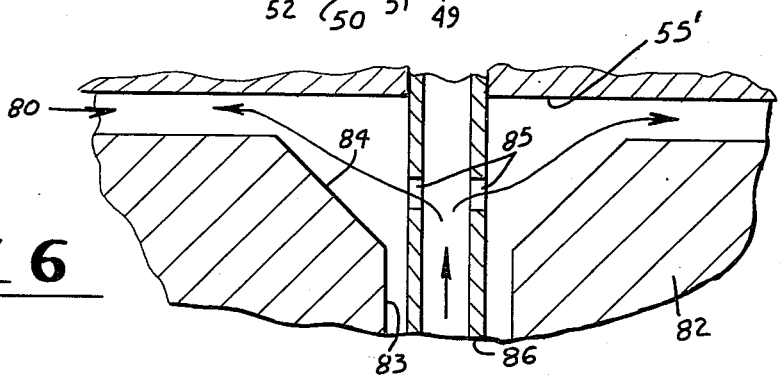
FIG. 6 is a cross-sectional view of a portion of printing apparatus of different configuration from shown in FIG. 4.
Figure 7:
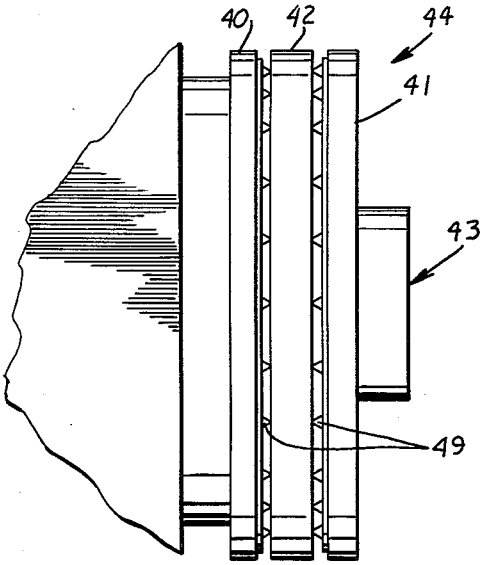
FIG. 7 is a side elevational view of a portion of the apparatus shown in FIG. 4 in an assembled configuration.

Since it is not always necessary to employ two axially space sets of channels the somewhat complex bolt structure just described may be eliminated where only one set of channels is employed. For example, FIG. 6 illustrates such a case where channels 80 radiate from a central region of a disc-shaped member 82 defined by cylindrical wall 83 that merges with a conically flared wall 84. Here holes 85 are provided in the sides of a hollow bolt 86. These holes are located facing the flared wall 84 which location aids in equalizing the distribution of medium flow from the two holes 85 to all of the channels thereabout which, of course, number more than two. In this case the confronting surface 55' of the other disc is completely flat.

Figure 9:
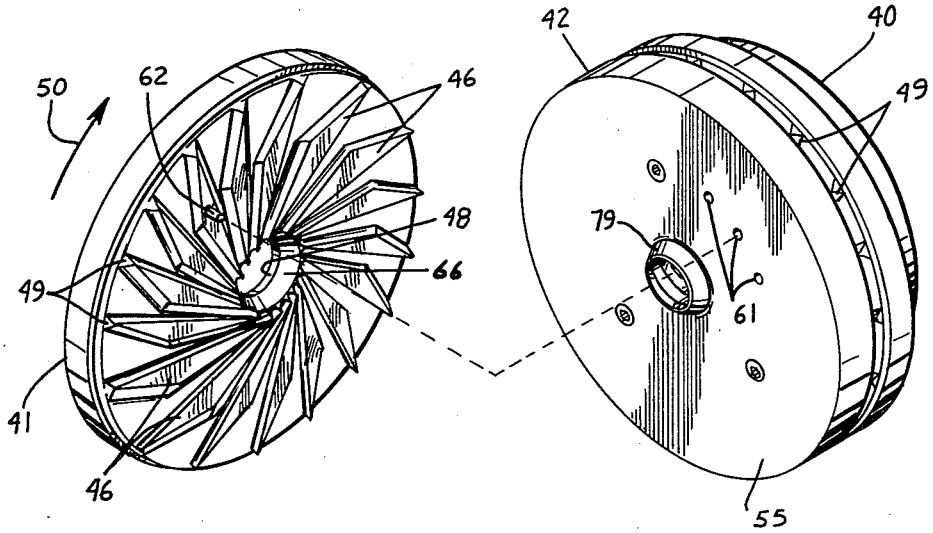
FIG. 9 is an exploded view, in perspective, of the apparatus shown in FIG. 4.

As best seen in FIG. 9, means are also provided for changing the angular position of the disc member 41 relative to the intermediate member 42 and to other disc member 40. This means includes a series of three pin holes 61 into which an indexing pin 62 that projects from one of the lands 46 on the member 41 may be seated. By mounting the member 41 to member 42 with the pin seated in a different pin hole, the relative position of the land tips 49 of discs 41 and 40 may be altered.

Figure 13:
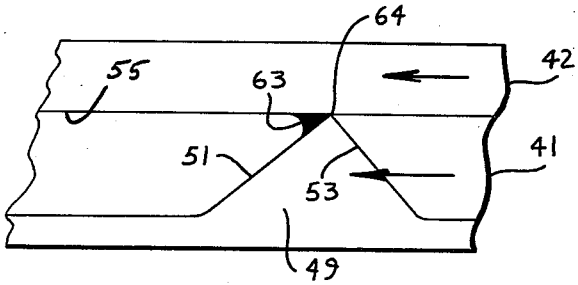
FIG. 13 is an enlarged, side elevational view of a peripheral fragment of the apparatus illustrated in FIG. 4.

With reference next to FIG. 13 it is seen that the juncture of land walls 51 with the planar surface 55 of disc-shaped member 42 forms an acute angle. The channel here thus has a generally wedge-shaped cross-sectional portion bounded by wall 51 and the surface 55 of the member 42 in which a stream of ink 63 may flow from the central to peripheral regions of the assembly during printing operations. Thus should a globule of solid or semi-solid consistency enter the stream it can extend outwardly from the wedge-shaped channel space to the left of the stream as viewed in FIG. 13 and into an adjacent portion of the channel. In this manner space is made available to accommodate many of such foreign objects or partially dried globules of the printing medium itself rather than have any such objects or globules clog the channel. Indeed, this feature even eliminates the need for providing a screen as with prior art devices which have had to be cleaned frequently.

FIG. 13 also illustrates another feature of the invention. Though most of a liquid printed medium will be forced to flow in a stream along the rotary leading side walls of the raised lands, a small portion may nevertheless sometimes be caused, such as by surface tension or capillary action, to flow along the rotary trailing side wall 53. However, since the walls 51 and 53 intersect at the surface of member 42 at tip 64, there two such streams will come together to form one confluent stream that is propelled by centrifugal force from the assembly. This serves to prevent phantom prints from being formed by any such secondary streams.

Figure 14:
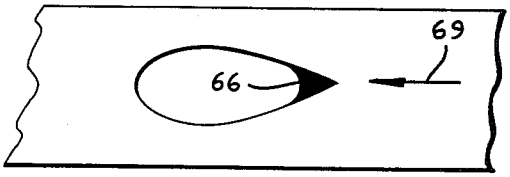
FIG. 14 is a side elevational view of a peripheral fragment of apparatus embodying principles of the invention in an alternative form.

If desired, a unitary disc-shaped structure, such as that illustrated in part in FIG. 14, may also be provided having a similar, generally wedge-shaped channel portion in which a stream 66 may flow with the structure rotating in the direction of arrow 69. In the case of such a unitary structure the channels must ordinarily form by machining and therefore the previously described embodiment is preferred for cost efficiency. In either case however the principle remains the same of forming a generally wedge-shaped channel section extending from a rotatably trailing channel side wall against which a stream flows from a central to peripheral region of the disc shaped rotatable member. The shape of the channel shown in FIG. 14 is seen to have very slightly curved walls bounding the wedge-shaped trailing portion. Such curvature should not be to such an extent as to cause the channel cross-sectional shape to approach cylindrical for in such a case even were the channel not to be completely filled with liquid marking medium the stream would assume a crescent cross-sectional shape. When propelled onto the elongated material the density of the ink would therefore be insufficient to make a well defined mark or would produce too wide a mark.

Figure 10:
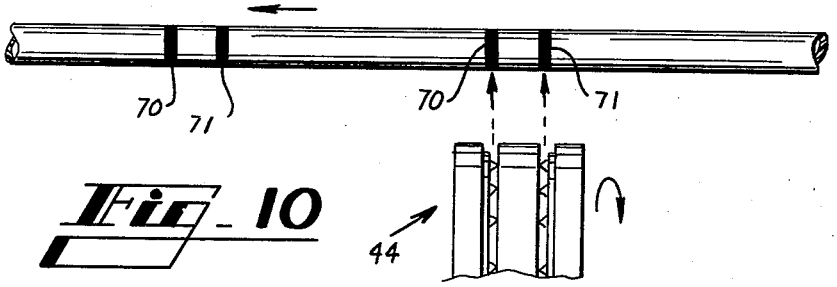
FIG. 10 illustrates a segment of elongated material being imprinted with one coded marking with the apparatus shown in FIG. 4 thereon.
Figure 11:
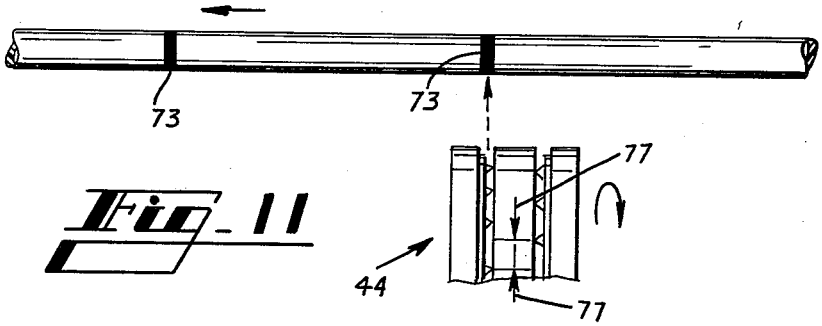
FIG. 11 illustrates a segment of elongated material being imprinted with another coded marking with the apparatus depicted in FIG. 4.
Figure 12:
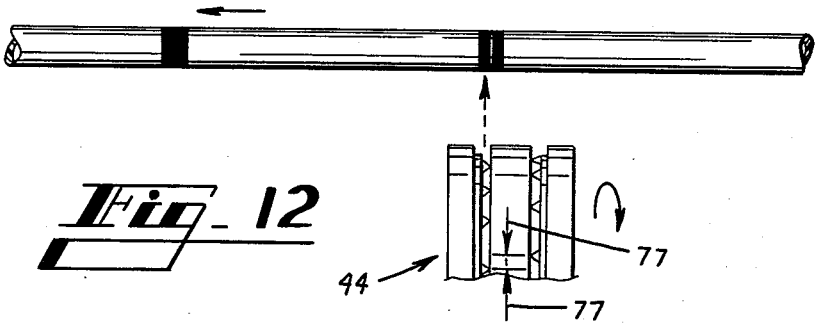
FIG. 12 illustrates a segment of elongated material being imprinted with yet anoter coded marking with the apparatus illustrated in FIG. 4.

FIGS. 10–12 illustrate a manner in which coded markings may be readily altered by merely changing the relative, radial positions of disc-shaped 40 and 41. In the position shown in FIG. 10 two band marks 70 and 71 are repeatedly formed from ink streams propelled from the channels of the two disc-shaped members with one member in one radial position relative to the other. By changing their relative positions to that shown in FIG. 11 by relocating pin 62 in another pin hole 61, the two sets of channels become mutually offset and the streams of ink emitted from the assembly by centrifugal force are made coincident to form a single mark 73, repeatedly. By another alteration, as indicated by index arrow 77, closely adjacent marks 74 and 75 may be printed upon the elongated material.

It thus is seen that printing apparatus is provided for printing encoded markings on elongated material with substantially diminished propensity of becoming clogged which apparatus may be readily self-adjusted to change the pattern or shape of printed markings. It should however be understood that the just described embodiments merely illustrate principles of the invention in selected, preferred forms. Many modifications, additions, and deletions may, of course, be made thereto without departure from the scope of the invention as set forth in the following claims.

What is claimed is:

1. Apparatus for printing encoded markings on elongated material comprising a first disc having a plurality of raised lands extending between central and peripheral disc regions; a second disc mounted to said first disc flush against said raised lands with at least one side wall of each of said lands being canted at an oblique angle with respect to said second disc; means for rotating said first and second discs together about an axis extending through said first disc central region; and means for channeling a liquid marking medium to said first disc central region, whereby upon rotation of the discs liquid marking medium channeled to the first disc central region may be propelled outwardly therefrom by centrifugal force along rotary leading canted side walls of said raised lands and into channels of wedge-shaped cross-sectional configuration bounded by the juncture of the canted, rotary leading side walls of the first disc raised lands and the second disc and onto elongated material moved past the apparatus as small well-defined streams.

2. Printing apparatus in accordance with claim 1 wherein each of said one side walls extends at an acute angle from said second disc.

3. Printing apparatus in accordance with claim 1 wherein each of said raised lands has two opposed mutually convergent side walls that intersect to form a triangularly shaped land tip whereby liquid marking medium flowing along the opposed side walls of each land may merge into a confluence in the disc peripheral region.

4. Printing apparatus in accordance with claims 1, 2 or 3 wherein said second disc has a substantially planar surface mounted flush against said raised lands.

5. Printing apparatus in accordance with claim 1 further comprising a third disc having a plurality of raised lands extending between central and peripheral third disc regions, means for mounting said third disc to said second disc with said third disc lands flush against said second disc, and means for channeling a liquid marking medium to said third disc central area.

6. Printing apparatus in accordance with claim 5 wherein said mounting means includes means for mounting said third disc in a plurality of angular positions with respect to said first and second discs to alter the spacing between adjacent marks printed on the elongated material.

* * * * *